US006528152B1

(12) United States Patent
Piriwe

(10) Patent No.: US 6,528,152 B1
(45) Date of Patent: Mar. 4, 2003

(54) STOPPER OF FOAMED THERMOPLASTIC SYNTHETIC MATERIAL

(75) Inventor: Gerhard Piriwe, Oberwaltersdorf (AU)

(73) Assignee: "P1"Handels GmbH, Österreich (AT)

( * ) Notice: Subject to any disclaimer, the term of this patent is extended or adjusted under 35 U.S.C. 154(b) by 0 days.

(21) Appl. No.: 09/484,705

(22) Filed: Jan. 18, 2000

(30) Foreign Application Priority Data

Jan. 25, 1999 (AT) ..... 97/99

(51) Int. Cl.[7] ..... B32B 3/00

(52) U.S. Cl. ..... 428/305.5; 428/317.9; 428/913; 215/230; 215/355; 521/920

(58) Field of Search ..... 428/317.9, 913, 428/305.5; 215/230, 355; 521/920

(56) References Cited

U.S. PATENT DOCUMENTS 4,363,849 A * 12/1982 Paisley et al. ..... 215/355
5,480,915 A * 1/1996 Burns ..... 215/355
5,994,465 A * 11/1999 Sudo et al. ..... 525/105
6,355,320 B1 * 3/2002 Allman et al. ..... 215/355

FOREIGN PATENT DOCUMENTS

| | | | |
|---|---|---|---|
| EP | WO 94/12352 | * | 6/1994 |
| EP | 0 947 352 A1 | | 10/1999 |
| WO | WO94/25513 A1 | | 11/1994 |
| WO | WO96/34806 A1 | | 11/1996 |

* cited by examiner

*Primary Examiner*—Terrel Morris
*Assistant Examiner*—Leanna Roché
(74) *Attorney, Agent, or Firm*—Kilpatrick Stockton, LLP

(57) ABSTRACT

A stopper of foamed thermoplastic synthetic material for sealing bottles containing foodstuffs or beverages, with an inorganic pigment which is resistant to and suitable for foodstuffs and which changes color under the influence of heat being added to the synthetic material.

A method of applying a cork stamp on the stopper which is exposed to the action of heat to color-activate the pigment in areas corresponding to a given pattern of a cork stamp.

7 Claims, No Drawings

STOPPER OF FOAMED THERMOPLASTIC SYNTHETIC MATERIAL

The invention relates to a stopper of foamed thermoplastic synthetic material for sealing bottles containing liquid foodstuffs or beverages. It also relates to a method of applying a cork stamp on the stopper.

As the designation "cork stamp" is a generally used term in particular in connection with wine for the designation of the origin and/or vintage year to be applied on a stopper consisting of cork, that term will be used in the following also for the analogous inscription on plastic stoppers.

For sealing bottles, in particular wine bottles, usually corks made of natural cork are used. However, the porosity of such corks differs and often varies already within small ranges. Moreover, such ranges of greater porosity are sometimes not detectable on the cork from outside.

Of course the greatly varying quality of corks made from natural cork lastingly affects the quality of e.g. the wine filled into and stored in these bottles. When the porosity of the cork is too great, the wine may take on a cork odour and may even become cloudy or spoil. This constitutes a great disadvantage in the use of cork stoppers for sealing bottles. In addition, corks made of natural cork are expensive and are getting even more expensive.

To apply a cork stamp on a cork stopper made of natural cork usually a branding iron is used with which the desired inscription and/or picture is burned into the cork stopper.

Known bottle stoppers made of plastic have so far been provided with a cork stamp in such a manner that an ink is applied by means of a stamp or a block. However, such an ink imprint does not adhere well to the plastic material of the cork and may as a rule be easily wiped off. The cork stamp is damaged or becomes partly illegible already when a bottle is corked up and when the stopper is removed to open the bottle.

The invention is based on the task of providing a stopper for sealing bottles of the type mentioned above which does not have the disadvantages of corks made of natural cork, but has a uniform high quality, which guarantees that no components of the stopper may migrate into the liquid foodstuff or beverage and which is also provided with a durable cork stamp. Moreover, the production of the stopper provided with a stamp should be economical.

This task is solved according to the invention by adding an inorganic pigment which is resistant to and suitable for foodstuffs and which changes its colour under the influence of heat to the synthetic material.

According to the invention it is therefore possible in a particularly simple and advantageous manner to durably apply a cork stamp on the stopper preferably by means of a program-controlled laser beam, with the synthetic material melting at the spots exposed to the heat and the inorganic pigment being colour-activated e.g. under reduction or oxidation of metal atoms or a metal compound.

According to the invention the pigments are natural or synthetic mineral pigments known per se, stone dust, metal oxides, metal hydroxides, hydrated metal oxides and/or mixtures thereof. As examples for pigments that can be used mica, titanium oxides, e.g. titanium dioxide, or iron oxides, e.g. iron(III) oxide, may be mentioned.

According to the invention the stopper is further characterized in that the share of the pigment changing its colour under the influence of heat amounts to from 0.01 to 50% by weight and preferably from 0.5 to 10% by weight, in particular from 1 to 3% by weight based on the total weight of the stopper.

The pigment percentage to be added substantially depends on the type of pigment chosen as well as the desired colour intensity of the cork stamp and may therefore vary within relatively wide ranges. If the pigment to be used is one which develops a great colour intensity under the influence of heat, the addition of very small quantities of pigment based on the total weight is possible, a lower limit of 0.01% by weight for the addition of pigment being sufficient. But the amount of pigment to be added also depends on the type of the synthetic material or the mixture of synthetic material chosen for the stopper because in many cases the synthetic material favours the colour intensity and contrast effect of the colour-activated pigment.

According to the invention the stopper is further characterized in that the synthetic material comprises polyolefines which are resistant to and suitable for foodstuffs, preferably polyethylenes, rubbers, silicones, polyurethanes and/or mixtures thereof.

A prerequisite for the synthetic material to be used for the production of a stopper corking up bottles according to the invention, in addition to its necessary resistance to and suitability for foodstuffs, is that as a whole it retains a certain elastic deformability after its processing to a stopper.

The invention also relates to a method of applying a cork stamp on a stopper according to the invention which is characterized in that the stopper is exposed to the action of heat in areas corresponding to a given pattern of a cork stamp to colour-activate the pigment.

According to the invention heat is applied by means of a laser or plasma beam or by means of a heated block over which the stopper is passed.

In this way it is possible in a simple and cheap manner to durably provide a plastic stopper with a cork stamp, contrary to the method known so far of applying a cork stamp on the plastic stopper by means of an ink imprint.

The stopper according to the invention is illustrated in greater detail in the following by means of a method of production.

Granulated plastic material or a mixture of granulated plastic materials, preferably a mixture of different PE granules, is heated at 220 to 260° C. in a reactor vessel with a foaming agent which is resistant to and suitable for foodstuffs and which guarantees fine porosity, homogeneously mixed with an added inorganic pigment which can be colour-activated by later action of heat, and is then fed to an injection molding machine. The liquid plastic mixture is then pressed under pressure by the injection molding machine into a mold to produce a stopper. The plastic mass pressed into the mold cools down at the walls of the mold, forming a non-porous skin enclosing an inner mass which remains finely porous. After appropriate cooling in the mold the finished plastic stopper is ejected.

The synthetic material used for producing the stopper may also be provided with a basic colouring by adding pigments or by a master batch with which colouring is effected; in doing so attention has to be paid to the fact that the pigment to be added and to be colour-activated by the later action of heat is a pigment which changes its colour to an appropriate contrasting colour to the basic colouring.

The skin of the finished plastic stopper may then be provided with a durable cork stamp as indicated above by means of a laser or plasma beam or mechanically by means of a heated block. Under the influence of heat the inorganic pigment contained and evenly distributed in the synthetic material of the stopper is colour-activated in areas corresponding to a given pattern of a cork stamp. These thermosensitive, colour-activated pigments become carriers of the cork stamp pattern which in this way is durably applied to the skin of the stopper and which cannot be wiped off.

What is claimed is:

1. A stopper of foamed thermoplastic synthetic materials for sealing bottles containing liquid foodstuffs or beverages, comprising an inorganic pigment and a predetermined pattern of color visible on an outer surface of the stopper, wherein the predetermined pattern is made by heating the inorganic pigment.

2. The stopper of claim 1, wherein the thermoplastic synthetic material is selected from the group consisting of polyolefins, polyethylenes, rubbers, silicones, polyurethanes and mixtures thereof.

3. The stopper of claim 1, wherein the pigment comprises natural or synthetic mineral pigments.

4. The stopper of claim 3, wherein the pigment is selected from the group consisting of stone dust, metal oxides, metal hydroxides, hydrated metal oxides and mixtures thereof.

5. The stopper of claim 1, wherein an amount of inorganic pigment that changes color due to the heating comprises from approximately 0.01% to 50% by weight based on the total weight of the stopper.

6. The stopper of claim 5, wherein the amount of pigment that changes color is from 0.5 to 10% by weight, based on the total weight of the stopper.

7. The stopper of claim 6, wherein the amount of pigment that changes color is from 1 to 3% by weight based on the total weight of the stopper.

* * * * *